US011072982B2

(12) United States Patent
Bushman et al.

(10) Patent No.: US 11,072,982 B2
(45) Date of Patent: Jul. 27, 2021

(54) ALIGNED DISC CHOKE FOR MANAGED PRESSURE DRILLING

(71) Applicant: Schlumberger Technology Corporation, Sugar Land, TX (US)

(72) Inventors: Jerod Bushman, Tomball, TX (US); Gocha Chochua, Sugar Land, TX (US); Shelby Wayne Carter, Sugar Land, TX (US); Henrix Soto, Houston, TX (US); Jeffrey Ham, Pearland, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 193 days.

(21) Appl. No.: 16/469,136

(22) PCT Filed: Dec. 11, 2017

(86) PCT No.: PCT/US2017/065497
§ 371 (c)(1),
(2) Date: Jun. 12, 2019

(87) PCT Pub. No.: WO2018/111733
PCT Pub. Date: Jun. 21, 2018

(65) Prior Publication Data

US 2020/0190922 A1 Jun. 18, 2020

Related U.S. Application Data

(60) Provisional application No. 62/437,855, filed on Dec. 22, 2016, provisional application No. 62/433,527, filed on Dec. 13, 2016.

(51) Int. Cl.
*E21B 21/08* (2006.01)
*E21B 21/10* (2006.01)

(52) U.S. Cl.
CPC ..... *E21B 21/08* (2013.01); *E21B 21/10* (2013.01)

(58) Field of Classification Search
CPC ..... E21B 21/08; E21B 21/10; E21B 33/085
See application file for complete search history.

(56) References Cited

U.S. PATENT DOCUMENTS 6,904,891 B2 6/2005 Tominaga et al.
7,108,080 B2 * 9/2006 Tessari ..... E21B 7/20 175/21

(Continued)

FOREIGN PATENT DOCUMENTS

WO 2011/084153 A1 7/2011
WO 2011119668 A1 9/2011

OTHER PUBLICATIONS

International Preliminary Report on Patentability for the equivalent International patent application PCT/US2017/065497 dated Jun. 27, 2019.

(Continued)

*Primary Examiner* — Michael R Wills, III

(57) ABSTRACT

A conduit forming part of a drilling fluid return path from a wellbore has at least one flow restrictor disposed on an interior surface of the conduit. A drill string is disposed through the interior of the conduit and has at least one flow restrictor disposed on an exterior surface of the drill string. The drill string is longitudinally movable through the conduit to enable placing the flow restrictor in the conduit, and the flow restrictor on the drill string at a selected longitudinal distance from each other.

15 Claims, 2 Drawing Sheets

(56) References Cited

U.S. PATENT DOCUMENTS

| | | | | |
|---|---|---|---|---|
| 7,325,606 | B1 * | 2/2008 | Vail, III | E21B 43/128 166/250.15 |
| 8,485,264 | B2 * | 7/2013 | Hutin | E21B 47/20 166/373 |
| 9,027,673 | B2 * | 5/2015 | Vail, III | E21B 17/18 175/100 |
| 9,157,295 | B2 * | 10/2015 | Head | E21B 33/14 |
| 9,611,700 | B2 * | 4/2017 | Zhou | E21B 21/08 |
| 9,957,774 | B2 * | 5/2018 | Clark | E21B 33/085 |
| 2006/0144620 | A1 * | 7/2006 | Cooper | E21B 33/138 175/57 |
| 2007/0278011 | A1 * | 12/2007 | Barnett | E21B 47/09 175/65 |
| 2008/0105434 | A1 | 5/2008 | Orbell et al. | |
| 2010/0319995 | A1 * | 12/2010 | Johnson | E21B 21/00 175/57 |
| 2012/0132442 | A1 | 5/2012 | Head | |
| 2013/0140034 | A1 | 6/2013 | Ghasripoor et al. | |
| 2014/0216816 | A1 | 8/2014 | Lehr | |
| 2016/0201426 | A1 | 2/2016 | Cohen | |

OTHER PUBLICATIONS

International Search Report and Written Opinion for the equivalent International patent application PCT/US2017/065497 dated Mar. 15, 2018.

Search and Examination Report R. 62 issued in European patent application 17880881.2 dated Jun. 25, 2020, 9 pages.

Office Action issued in Azerbaijan patent application a2019 0070 dated Nov. 11, 2020, 4 pages includes English Translation.

* cited by examiner

ALIGNED DISC CHOKE FOR MANAGED PRESSURE DRILLING

This application claims the benefit of and priority to two U.S. Provisional Applications, having Ser. No. 62/433,527, filed 13 Dec. 2016, and Ser. No. 62/437,855, filed on 22 Dec. 2016, which are incorporated by reference herein. The disclosure relates generally to the field of "managed pressure" wellbore drilling. More specifically, the disclosure relates to managed pressure control apparatus and methods which may not require the use of a rotating control device ("RCD"), rotating blowout preventer or similar apparatus to restrict or close a wellbore annulus.

BACKGROUND

Managed pressure drilling uses well pressure control systems that control return flow of drilling fluid in a wellbore annulus to maintain a selected pressure or pressure profile in a wellbore. U.S. Pat. No. 6,904,891 issued to van Riet describes one such system for controlling wellbore pressure during the drilling of a wellbore through subterranean formations. The system described in the '891 patent includes a drill string extending into the wellbore. The drill string may include a bottom hole assembly ("BHA") including a drill bit, drill collars, sensors (which may be disposed in one or more of the drill collars), and a telemetry system capable of receiving and transmitting sensor data between the BHA and a control system disposed at the surface. Sensors disposed in the bottom hole assembly may include pressure and temperature sensors. The control system may comprise a telemetry system for receiving telemetry signals from the sensors and for transmitting commands and data to certain components in the BHA.

A drilling fluid ("mud") pump or pumps may selectively pump drilling fluid from a drilling fluid reservoir, through the drill string, out from the drill bit at the end of the drill string and into an annular space created as the drill string penetrates the subsurface formations. A fluid discharge conduit is in fluid communication with the annular space for discharging the drilling fluid to the reservoir to clean the drilling fluid for reuse. A fluid back pressure system is connected to the fluid discharge conduit. The fluid back pressure system may include a flow meter, a controllable orifice fluid choke, a backpressure pump and a fluid source coupled to the pump intake. The backpressure pump may be selectively activated to increase annular space drilling fluid pressure. Other examples may exclude the back-pressure pump.

Systems such as those described in the van Riet '891 patent comprise a RCD or similar rotatable sealing element at a selected position, in some implementations at or near the upper end of the wellbore. The upper end of the wellbore may be a surface casing extending into the subsurface and cemented in place, or in the case of marine wellbore drilling, may comprise a conduit called a "riser" that extends from a wellhead disposed on the water bottom and extending to a drilling platform proximate the water surface. Further, in such systems as described in the van Riet '891 patent, a fluid discharge line from the upper end of the wellbore but below the RCD may comprise devices such as a controllable orifice choke such that drilling fluid returning from the wellbore may have its flow controllably restricted to provide a selected fluid pressure in the wellbore or a selected fluid pressure profile (i.e., fluid pressure with respect to depth in the wellbore).

It is desirable to provide control of fluid pressure in a wellbore without the need to use RCDs or similar rotating pressure control devices at the upper end of the well.

DETAILED DESCRIPTION

Figure 1:
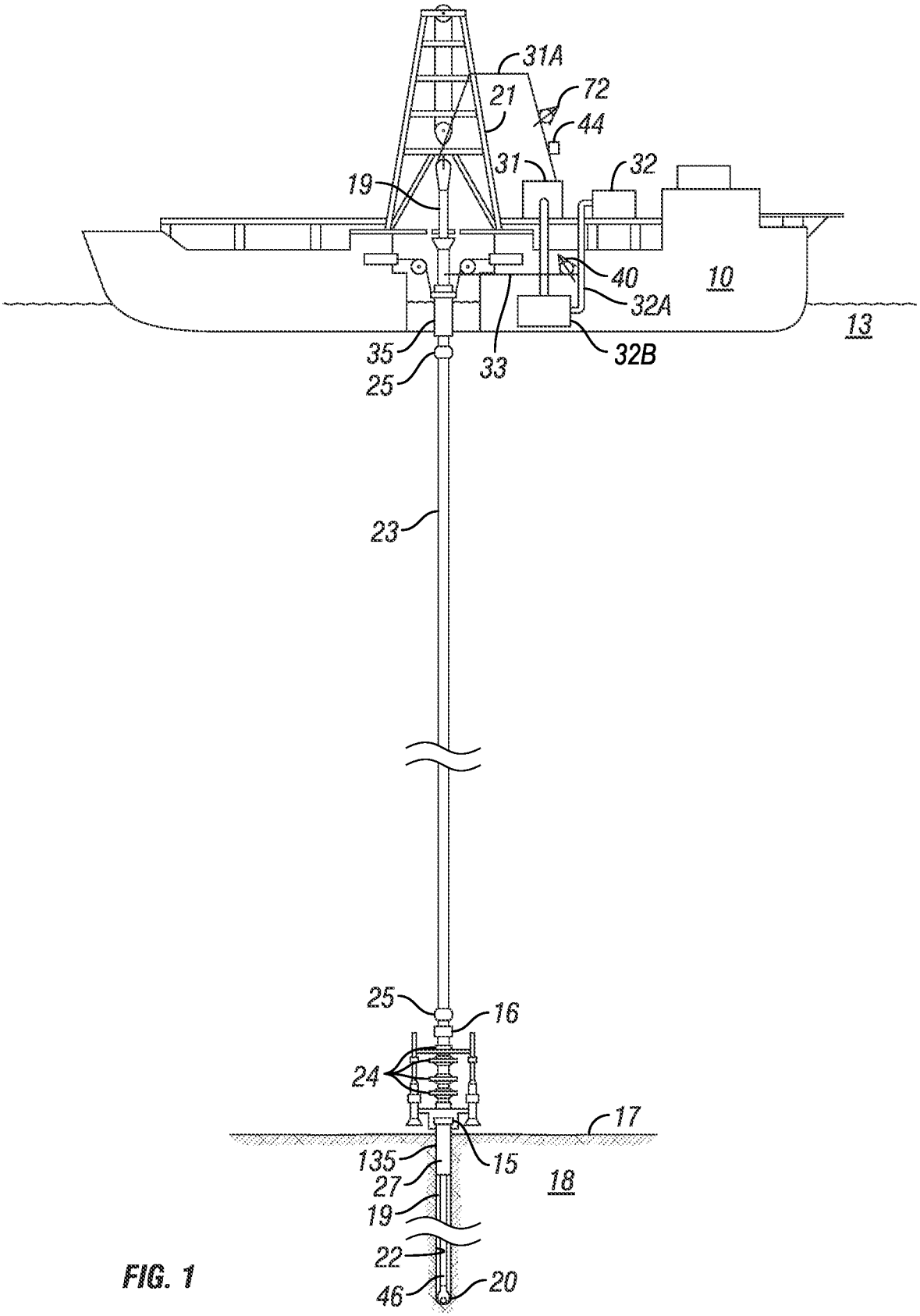
FIG. 1 illustrates an example embodiment of a drilling system including a well pressure control apparatus.

FIG. 1 shows an example drilling apparatus that may be used in some embodiments. While the present example embodiment is described with reference to drilling a well below the bottom of a body of water, it should by clearly understood that other embodiments may be used about drilling a well below the land surface.

A drilling vessel 10 floats on the surface of a body of water 13. A wellhead 15 is positioned on the water bottom 17. The wellhead 15 which defines the upper surface or "mudline" of a wellbore 22 drilled through sub-bottom formations 18. A drill string 19 having a drill bit 20 disposed at a bottom end thereof are suspended from a derrick 21 mounted on the drilling vessel 10. The drill string 19 may extend from the derrick 21 to the bottom of the wellbore 22. A length of structural casing 27 extends from the wellhead 15 to a selected depth in the wellbore 22. In the present example embodiment, a riser 23 may extend from the upper end of a blowout preventer stack 24 coupled to the wellhead 15, upwardly to the drilling vessel 10. The riser 23 may comprise flexible couplings such as ball joints 25 proximate each longitudinal end of the riser 23 to enable some movement of the drilling vessel 10 without causing damage to the riser 23.

A flow control 35 may be disposed at a selected longitudinal position along the riser 23. In the present example embodiment, the flow control 35 may be disposed proximate a drilling fluid outlet 33 coupled proximate the top of the riser 23. The drilling fluid outlet 33 may comprise a flowmeter 40 to measure the rate at which fluid is discharged from the riser 23, and thus the wellbore 22. A drilling fluid treatment system 32 which may comprise components (none shown separately for clarity) such as a gas separator, one or more shaker tables and a clean drilling fluid return line 32A which returns cleaned drilling fluid to a tank or reservoir 32B.

A pump 31 disposed on the drilling vessel 10 may lift drilling fluid from the tank 32B and discharge the lifted drilling fluid into a standpipe 31A or similar conduit. The standpipe 31A is in fluid communication with the interior of the drill string 19 at the upper end of the drill string 19 such that the discharged drilling fluid moves through the drill string 19 downwardly and is ultimately discharged through nozzles, jets or courses on the drill bit 20 and thereby into the wellbore 22. The drilling fluid moves along the interior of the wellbore 22 upwardly into the riser 23 until it reaches the fluid outlet 33. A pressure sensor 44 and a flowmeter 42 may be placed in fluid communication with the pump 31 discharge at any selected position between the pump 31 and the upper end of the drill string 19. The pressure sensor 44 may measure pressure of the drilling fluid in the standpipe 31A and the flowmeter may measure rate of flow of the drilling fluid through the standpipe 31A to enable determining pressure of the drilling fluid at any longitudinal position along the wellbore 22 and/or the riser 23.

In some embodiments, a pressure sensor may be disposed proximate the bottom end of the drill string 19, such pressure sensor being shown at 46. The pressure sensor 46 may communicates measurements to the drilling vessel 10 using signal transmission devices known in the art.

In some embodiments, a flow control 135 may be disposed within the casing 27 proximate its upper end. Such placement of a flow control 135 may be used for drilling below the land surface, where the casing may perform the function of a return conduit for the drilling fluid. For purposes of defining the scope of the present disclosure, the flow control shown at 35 in the riser 23 and the flow control 135 in the casing 27 may be used for the same purpose, namely to control discharge of the drilling fluid from the wellbore 22 so that a selected wellbore drilling fluid pressure may be maintained.

Figure 2:
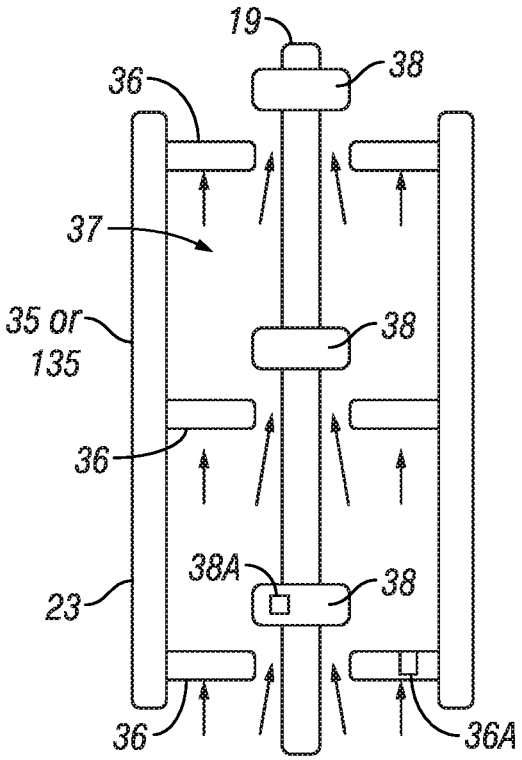
FIG. 2 illustrates a detailed view of one example embodiment of a well pressure control apparatus.
Figure 3:
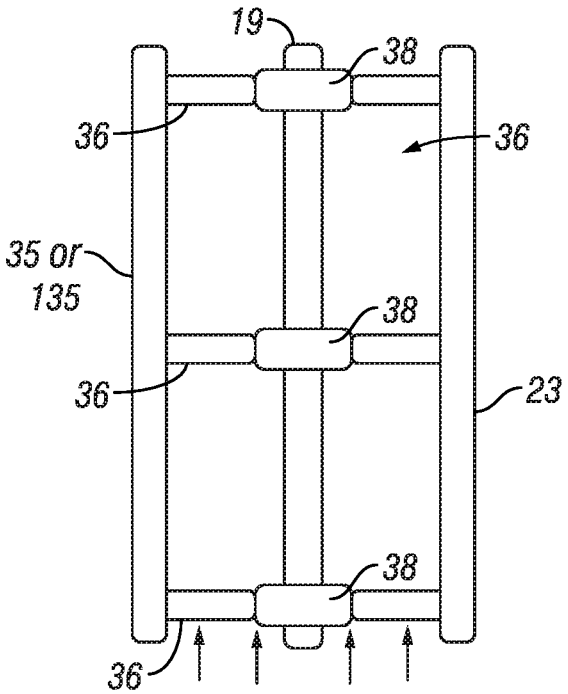
FIG. 3 shows the pressure control apparatus of FIG. 2 in the fully closed position.

An example embodiment of a flow control may be better understood with reference to FIGS. 2 and 3. The flow control, e.g., as shown at 35 in FIG. 1 or at 135 in FIG. 1 may comprise at least one flow restrictor 36 disposed on the interior surface of the riser 23 (or on the interior surface of the casing 22 for land drilling or riser less marine drilling). The drill string 19 may comprise at least one flow restrictor 38 on its exterior surface. In the embodiment shown in FIG. 2 there are three such corresponding flow restrictors 36, 38, however the number of such flow restrictors is not intended to limit the scope of the present disclosure. In FIG. 2 the flow restrictor(s) 36 on the interior of the riser 23 and the flow restrictor(s) 38 on the exterior of the drill string 19 are longitudinally displaced from each other such that drilling fluid may flow freely in the annular space 37 between the drill string 19 and the riser 23 (or casing 27 in FIG. 1).

In some embodiments, the flow restrictor(s) 36 on the interior of the riser 23 and the flow restrictor(s) 38 on the exterior of the drill string 19 each may be a substantially circular disc. Such embodiments may enable substantial closure of the well to flow in the annular space 37 while enabling rotation of the drill string 19 to continue.

In FIG. 3, the flow restrictor(s) 36 on the interior of the riser 23 and the flow restrictor(s) 38 on the exterior of the drill string 19 are at the same longitudinal position, such that flow in the annular space 37 is restricted. Either or both of the flow restrictor(s) 36 on the interior of the riser 23 and the flow restrictor(s) 38 on the exterior of the drill string 19 may comprise one or more openings 36A, 38A, respectively, such that when the flow restrictor(s) 36 on the interior of the riser 23 and the flow restrictor(s) 38 on the exterior of the drill string 19 are at the same longitudinal position, flow through the annular space is not completely stopped, but may be restricted by a predetermined amount. Such openings may be of any suitable configuration, for example and without limitation, holes, slots, and one or more notches in the exterior surface. In some embodiments, the flow restrictor(s) 36 on the interior of the riser 23 and the flow restrictor(s) 38 on the exterior of the drill string 19 may have respective inner and outer diameters that differ from each other by a selected amount, such that a predetermined flow restriction is provided when the flow restrictor(s) 36 on the interior of the riser 23 and the flow restrictor(s) 38 on the exterior of the drill string 19 are at the same longitudinal position. In some embodiments, where a plurality of the flow restrictors 36 on the interior of the riser 23 and the flow restrictors 38 on the exterior of the drill string 19 are used, a longitudinal spacing between the flow restrictors 36 on the interior of the riser 23 and the flow restrictors 38 on the exterior of the drill string 19 may be respectively longitudinally spaced apart by a length of each segment ("joint") of the drill string 19.

The flow control 35 may be used in managed pressure drilling to maintain a selected pressure or pressure profile (pressure with respect to depth in the wellbore 22) in the wellbore (22 in FIG. 1). Methods for estimating pressure may comprise measuring pressure and flow rate of drilling fluid entering the drill string 19, e.g., using pressure sensor 44 and flowmeter 42, measuring flow rate of the drilling fluid out of the wellbore, e.g., using flowmeter 40, and using the foregoing measurements in a hydraulics model. Using such measurements and calculating wellbore pressure using a hydraulics model is described in U.S. Pat. No. 6,904,891 issued to van Riet. In some embodiments, where a wellbore pressure sensor is used, e.g., as shown at 46, the wellbore fluid pressure may be measured directly, or may be used to calibrate the pressure determined from the hydraulics model. The wellbore fluid pressure may be controlled by moving the flow restrictor(s) 36 on the interior of the riser 23 and the flow restrictor(s) 38 on the exterior of the drill string 19 longitudinally with respect to each other to provide a selected flow restriction in the riser 23 or casing 27. In the present example embodiment, such longitudinal motion may be performed by lifting or lowering the drill string 19.

While the present disclosure describes a limited number of embodiments, those skilled in the art, having benefit of this disclosure, will appreciate that other embodiments can be devised which do not depart from the scope of what has been disclosed herein. Accordingly, the scope of the disclosure should be limited only by the attached claims.

What is claimed is:

1. A system, comprising:

a drill string extending into a wellbore drilled through subsurface formations;

a pump having an inlet in fluid communication with a supply of drilling fluid, the pump having an outlet in fluid communication with an interior of the drill string;

a conduit extending from a selected axial position in the wellbore to a position proximate a surface end of the wellbore; and at least one flow restrictor disposed on an interior surface of the conduit; and at least one flow restrictor disposed on an exterior surface of the drill string and arranged to function cooperatively with the at least one flow restrictor on the interior surface of the conduit to selectively restrict flow of drilling fluid between the drill string and the conduit.

2. The system of claim 1 wherein at least one of the flow restrictor on the exterior of the drill string and the flow restrictor on the interior of the conduit comprises at least one opening such that a selected flow restriction results when the flow restrictor on the drill string and the flow restrictor in the conduit are at a same longitudinal position in the wellbore.

3. The system of claim 1 wherein the flow restrictor on the exterior of the drill string has a selected outer diameter and the flow restrictor on the interior of the conduit has a selected inner diameter, a difference between the selected outer diameter and the selected inner diameter creating a selected diameter annular space when the flow restrictor on the drill string and the flow restrictor in the conduit are at a same longitudinal position in the wellbore.

4. The system of claim 1, wherein the at least one flow restrictor on the interior surface comprises a plurality of longitudinally spaced apart flow restrictors disposed on the interior surface of the conduit and wherein the at least one flow restrictor on the exterior surface comprises a corresponding plurality of longitudinally spaced apart flow restrictors disposed on the exterior surface of the drill string.

5. The system of claim 4 wherein a longitudinal spacing between adjacent ones of the flow restrictors on the interior of the conduit and on the exterior of the drill string corresponds to a length of each of a plurality of segments of the drill string.

6. The system of claim 4 wherein at least one of (I) each of the flow restrictors on the exterior of the drill string and (ii) each of the flow restrictors on the interior of the conduit comprises at least one opening such that a selected flow restriction results when the flow restrictors on the drill string and the flow restrictors in the conduit are at correspondingly same longitudinal positions in the wellbore.

7. The system of claim 4 wherein each of the flow restrictors on the exterior of the drill string has a selected outer diameter and each of the flow restrictors on the interior of the conduit has a selected inner diameter, a difference between the selected outer diameter and the selected inner diameter creating a selected diameter annular space when the flow restrictors on the drill string and the flow restrictors in the conduit are at correspondingly same longitudinal positions in the wellbore.

8. The system of claim 4, wherein each of the flow restrictors on the exterior of the drill string has a selected outer diameter and each of the flow restrictors on the interior of the conduit comprises a substantially circular disc.

9. A method, comprising:

pumping drilling fluid through a drill string extended into a wellbore drilled through subsurface formations;

returning the pumped drilling fluid through an annular space between an exterior of the drill string and an interior of a conduit disposed to a selected depth in the wellbore; and selectively restricting discharge of fluid from the interior of the conduit by controlling a longitudinal distance between at least one flow restrictor disposed on an interior surface of the conduit and at least one flow restrictor disposed on an exterior surface of the drill string and arranged to function cooperatively with the at least one flow restrictor on the interior surface of the conduit.

10. The method of claim 9, further comprising measuring a pressure of the drilling fluid in the conduit below the flow restrictors and controlling the longitudinal distance to maintain a selected measured pressure.

11. The method of claim 9, further comprising measuring a pressure of drilling fluid entering an interior of the drill string and measuring a flow rate of drilling fluid entering the drill string or a flow rate of drilling fluid exiting the conduit, and controlling the longitudinal distance to maintain a selected measured pressure and measured flow rate.

12. The method of claim 9, further comprising selectively restricting discharge of fluid from the interior of the conduit by controlling a longitudinal distance between each of a plurality of longitudinally spaced apart flow restrictors disposed on the interior surface of the conduit and a corresponding plurality of flow restrictors disposed on the exterior surface of the drill string and arranged to function cooperatively with the flow restrictors on the interior of the conduit.

13. An apparatus, comprising:

a conduit forming part of a drilling fluid return path from a wellbore, the conduit comprising at least one flow restrictor disposed on an interior surface of the conduit; and a drill string disposed through the interior of the conduit, the drill string comprising at least one flow restrictor disposed on an exterior surface of the drill string, the drill string longitudinally movable through the conduit to enable placing the flow restrictor in the conduit and the flow restrictor on the drill string at a selected longitudinal distance from each other.

14. The apparatus of claim 13, further comprising a plurality of longitudinally spaced apart flow restrictors disposed on the interior surface of the conduit a corresponding plurality of longitudinally spaced apart flow restrictors disposed on the exterior surface of the drill string.

15. The apparatus of claim 13, wherein at least one of the flow restrictor on the drill string and the flow restrictor in the conduit comprises at least one opening therein, such that a selected flow restriction is provided when the flow restrictor on the drill string and the flow restrictor in the conduit are at a same longitudinal position as each other.

* * * * *